US011596203B2

(12) United States Patent
Berns et al.

(10) Patent No.: US 11,596,203 B2
(45) **Date of Patent: *Mar. 7, 2023**

(54) FOOTWEAR UPPER INCLUDING VARIABLE STITCH DENSITY

(71) Applicant: Under Armour, Inc., Baltimore, MD (US)

(72) Inventors: Jason Berns, New York, NY (US); Julian Ellis, Nottingham (GB); Tom Luedecke, Portland, OR (US); Thomas White, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 75 days.

This patent is subject to a terminal disclaimer.

(21) Appl. No.: 16/857,577

(22) Filed: Apr. 24, 2020

(65) Prior Publication Data

US 2020/0245721 A1 Aug. 6, 2020

Related U.S. Application Data

(63) Continuation of application No. 15/176,476, filed on Jun. 8, 2016, now Pat. No. 10,645,999, which is a (Continued)

(51) Int. Cl.
*A43B 23/02* (2006.01)
*A43B 1/04* (2022.01)
(Continued)

(52) U.S. Cl.
CPC ..... *A43B 23/026* (2013.01); *A43B 1/04* (2013.01); *A43B 7/14* (2013.01); *A43B 7/20* (2013.01);
(Continued)

(58) Field of Classification Search
CPC ..... A43B 23/026; A43B 1/04; A43B 7/14; A43B 23/0205; A43B 23/0215;
(Continued)

(56) References Cited

U.S. PATENT DOCUMENTS 1,493,565 A * 5/1924 Raboni ..... A43B 13/10 36/85
2,033,096 A 3/1936 Drumheller
(Continued)

FOREIGN PATENT DOCUMENTS

CN 101077234 A 11/2007
KR 695801 3/2007
(Continued)

OTHER PUBLICATIONS

Final Office Action, CN Application/Publication No. 201580008660.7, dated Dec. 31, 2017.
(Continued)

*Primary Examiner* — Alissa J Tompkins
*Assistant Examiner* — Catherine M Ferreira
(74) *Attorney, Agent, or Firm* — Edell, Shapiro & Finnan LLC

(57) ABSTRACT

An article of footwear includes a sole and an upper at least partially formed of a textile element. The textile element includes a yarn matrix having a plurality of interlocked strands oriented in predetermined directions. A structural element may be captured within the matrix at selected locations. In operation, the matrix is stitched onto a temporary substrate. The substrate is removed and the article coupled to a sole structure to form the article of footwear.

15 Claims, 9 Drawing Sheets

Related U.S. Application Data continuation of application No. 14/668,935, filed on Mar. 25, 2015, now abandoned.

(60) Provisional application No. 61/970,070, filed on Mar. 25, 2014.

(51) Int. Cl.

| | |
|---|---|
| ***A43B 23/04*** | (2006.01) |
| ***D05C 17/00*** | (2006.01) |
| ***A43B 7/14*** | (2022.01) |
| ***A43B 7/20*** | (2006.01) |
| ***A43B 23/08*** | (2006.01) |
| ***A43B 23/17*** | (2006.01) |

(52) U.S. Cl.

CPC ..... *A43B 23/023* (2013.01); *A43B 23/0205* (2013.01); *A43B 23/025* (2013.01); *A43B 23/027* (2013.01); *A43B 23/028* (2013.01); *A43B 23/0215* (2013.01); *A43B 23/0225* (2013.01); *A43B 23/0265* (2013.01); *A43B 23/042* (2013.01); *A43B 23/087* (2013.01); *A43B 23/17* (2013.01); *D05C 17/00* (2013.01)

(58) Field of Classification Search

CPC ... A43B 23/025; A43B 23/027; A43B 23/028; A43B 23/042

USPC ..... 36/55

See application file for complete search history.

(56) References Cited

U.S. PATENT DOCUMENTS

| | | | | |
|---|---|---|---|---|
| 2,147,197 | A | 2/1939 | Glidden | |
| 2,314,098 | A | 3/1943 | McDonald | |
| 2,334,659 | A | 11/1943 | Arsdale et al. | |
| 2,400,692 | A | 5/1946 | Herbert | |
| 2,440,393 | A | 4/1948 | Clark | |
| 2,467,237 | A | 4/1949 | Sherman et al. | |
| 2,538,673 | A | 1/1951 | Donahue | |
| 2,586,045 | A | 2/1952 | Hoza | |
| 2,641,004 | A | 6/1953 | Whiting et al. | |
| 4,073,299 | A | 2/1978 | Murata | |
| 4,254,563 | A | 3/1981 | Bruno | |
| 5,345,638 | A * | 9/1994 | Nishida | A41H 3/08 12/146 C |
| 6,672,938 | B2 | 1/2004 | del Oimo | |
| 6,910,288 | B2 | 6/2005 | Dua | |
| 6,931,762 | B1 | 8/2005 | Dua | |
| 7,347,011 | B2 | 3/2008 | Dua et al. | |
| 7,574,818 | B2 | 8/2009 | Meschter | |
| 7,713,463 | B1 | 5/2010 | Reah et al. | |
| 7,770,307 | B2 | 8/2010 | Meschter | |
| 7,774,884 | B2 | 8/2010 | Greene et al. | |
| 7,814,598 | B2 | 10/2010 | Dua et al. | |
| 7,814,852 | B2 | 10/2010 | Meschter | |
| 7,870,681 | B2 | 1/2011 | Meschter | |
| 7,870,682 | B2 | 1/2011 | Meschter et al. | |
| 7,942,104 | B2 | 5/2011 | Butcher et al. | |
| 7,946,236 | B2 * | 5/2011 | Butcher | A61F 2/0063 112/475.18 |
| 8,042,288 | B2 | 10/2011 | Dua et al. | |
| 8,074,591 | B2 | 12/2011 | Butcher et al. | |
| 8,122,616 | B2 | 2/2012 | Meschter et al. | |
| 8,132,340 | B2 | 3/2012 | Meschter | |
| 8,209,883 | B2 | 7/2012 | Lyden | |
| 8,266,827 | B2 | 9/2012 | Dojan et al. | |
| 8,464,441 | B2 | 6/2013 | Meschter et al. | |
| 8,555,415 | B2 | 10/2013 | Bradstreet et al. | |
| 8,631,589 | B2 | 1/2014 | Dojan | |
| 8,819,963 | B2 | 9/2014 | Dojan et al. | |
| 8,844,167 | B2 | 9/2014 | Greene | |
| 8,887,410 | B2 | 11/2014 | Dojan et al. | |
| 8,904,671 | B2 | 12/2014 | Dojan et al. | |
| 8,915,764 | B2 | 12/2014 | Scott et al. | |
| 8,925,129 | B2 | 1/2015 | Dojan et al. | |
| 8,973,288 | B2 | 3/2015 | Dojan et al. | |
| 9,055,785 | B2 | 6/2015 | Dojan et al. | |
| 9,179,739 | B2 | 11/2015 | Bell et al. | |
| 9,192,204 | B1 | 11/2015 | Liles et al. | |
| 9,198,479 | B2 | 12/2015 | Dojan | |
| 9,402,444 | B2 | 8/2016 | Dojan et al. | |
| 9,820,843 | B2 * | 11/2017 | Greenhalgh | A61L 31/005 |
| 2004/0118018 | A1 | 6/2004 | Dua | |
| 2004/0181972 | A1 | 9/2004 | Csorba | |
| 2006/0048413 | A1 | 3/2006 | Sokolowski | |
| 2007/0271822 | A1 * | 11/2007 | Meschter | A43B 23/0235 36/45 |
| 2008/0110048 | A1 | 5/2008 | Dua | |
| 2008/0178786 | A1 * | 7/2008 | Butcher | A61F 2/0063 112/439 |
| 2009/0071041 | A1 | 3/2009 | Hooper | |
| 2010/0017974 | A1 * | 1/2010 | RongBo | A43B 9/02 12/145 |
| 2010/0089297 | A1 * | 4/2010 | Butcher | D05C 7/00 112/440 |
| 2010/0154256 | A1 | 6/2010 | Dua | |
| 2010/0251564 | A1 | 10/2010 | Meschter | |
| 2012/0297642 | A1 * | 11/2012 | Schaefer | A43B 1/0027 36/45 |
| 2013/0019500 | A1 | 1/2013 | Greene | |
| 2013/0025159 | A1 | 1/2013 | Dojan et al. | |
| 2013/0055590 | A1 | 3/2013 | Mokos | |
| 2013/0152424 | A1 | 6/2013 | Dojan | |
| 2013/0219750 | A1 * | 8/2013 | Dojan | A43C 1/04 36/87 |

FOREIGN PATENT DOCUMENTS

| | | | |
|---|---|---|---|
| KR | 2008084329 | A | 9/2008 |
| WO | 9843506 | A1 | 10/1998 |
| WO | 2011028441 | A1 | 3/2011 |
| WO | 2011028444 | A1 | 3/2011 |

OTHER PUBLICATIONS

International Search Report, PCT/US2015/022584, dated Aug. 20, 2015.

* cited by examiner

FOOTWEAR UPPER INCLUDING VARIABLE STITCH DENSITY

CROSS REFERENCE TO RELATED APPLICATIONS

The present application is a continuation of U.S. Nonprovisional application Ser. No. 15/176,476, filed 8 Jun. 2016 and entitled "Footwear Upper Including Variable Stitch Density", which is a continuation of U.S. Nonprovisional application Ser. No. 14/668,935, filed 25 Mar. 2015 and entitled "Footwear Including Textile Element," which, in turn, claims priority to provisional application 61/970,070, filed on 25 Mar. 2014 and entitled "Footwear Including Embroidered Element." The disclosure of each of the aforementioned applications is incorporated herein by reference in its entirety.

FIELD OF THE INVENTION

The present invention is directed to footwear and, in particular, to an article of footwear with an upper including textile element and a method of forming the article of footwear.

BACKGROUND OF THE INVENTION

Athletic footwear such as running shoes is designed for comfort and durability. Athletic footwear is typically formed of materials having insulating, moisture resistant, and/or abrasion-resistant properties. Typical athletic uppers are a laminate of individual layers, with each layer imparting different properties to the upper. For example, an upper for athletic footwear includes an exterior layer, an intermediate layer, and an interior layer joined via an adhesive. The exterior layer is formed from one or more of leather, synthetic leather, rubber, or synthetic textile. The intermediate layer us formed of foam, and the interior layer is a textile.

Such conventional athletic footwear, while durable, is heavy since each layer of the upper adds weight to the footwear. In addition, this type of construction interferes with the breathability of the upper, requiring further modification to compensate. Thus, it would be desirable to provide an upper that is light, while durable for use in performance footwear.

BRIEF SUMMARY OF THE INVENTION

The present invention is directed toward an article of manufacture including a textile element. Specifically, an article of footwear includes a sole and an upper at least partially formed of an embroidered element. The textile element includes a yarn matrix having a plurality of interlocked strands oriented in predetermined directions. A structural element may be captured within the matrix at selected locations. In operation, the matrix is stitched onto a temporary substrate. The substrate is removed and the article coupled to a sole structure to form the article of footwear.

BRIEF DESCRIPTION OF THE SEVERAL VIEWS OF THE DRAWINGS

Like numerals have been utilized to identify like components throughout the figures.

DETAILED DESCRIPTION OF THE INVENTION

Figure 1:
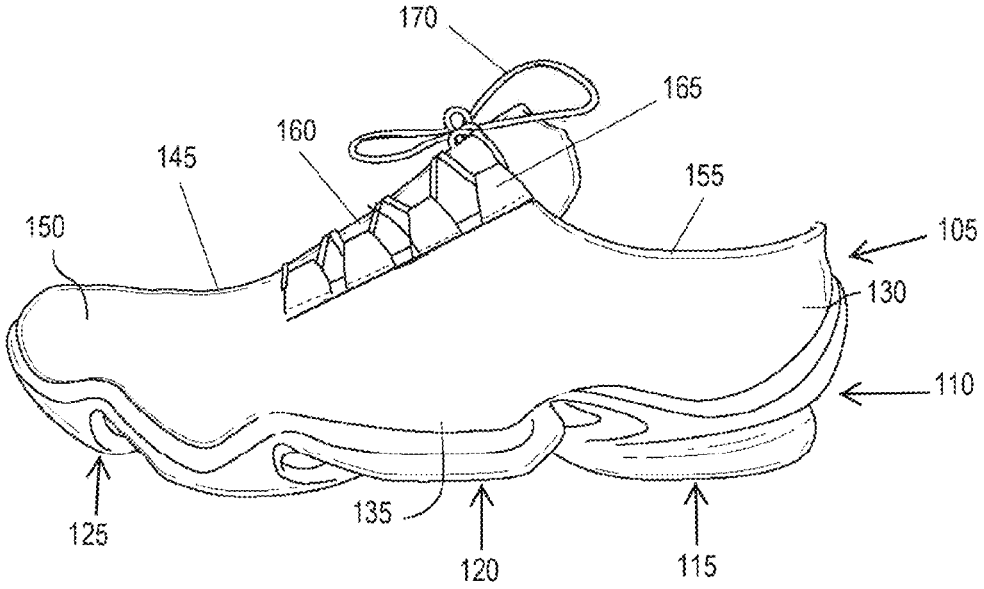
FIG. 1 is a side view of an article of footwear including an upper in accordance with an embodiment of the present invention.

Turning to FIG. 1, the article of manufacture is an article of footwear 10 including an upper 105 and a sole structure 110. The footwear 10 defines several regions corresponding with various parts of a foot. Specifically, the footwear defines a rear footwear region 115 generally corresponding with the rear of the foot (e.g., the hindfoot including the heel); an intermediate footwear region 120 disposed forward the rear region and generally corresponding to the midfoot (e.g., the arched (instep) and ball areas of the foot); and a forward footwear region 125 disposed forward of intermediate region and generally corresponding to the forefoot (e.g., the toes of the foot).

The upper 105 includes a heel 130, a lateral side 135, a medial side 140, an instep 145, and a toe cage or box 150. The heel 145 forms a rear portion of upper 10 and is generally configured to extend along the heel of the foot. The lateral side 135 spans through a longitudinal length of the article footwear 10, being configured to extend along the lateral side of the foot. Similarly, the medial side 140 spans a longitudinal length of footwear, being configured to extend along the medial side of the foot. The instep 145, positioned between the lateral side and the medial side, extends along the instep of the foot. Finally, the toe cage 150 defines the forward area of the upper 105, being configured to house the toes of the foot.

The upper 105 forms a cavity that receives the foot. Specifically, the heel 130, lateral side 135, medial side 140, instep 145, and toe cage 150 cooperate to define an interior cavity into which a foot is inserted by way of an access opening or collar 155. The upper may further include a tongue 160 and lace connections 165 (e.g., eyelets) that receive a lace 170.

Figure 2A:
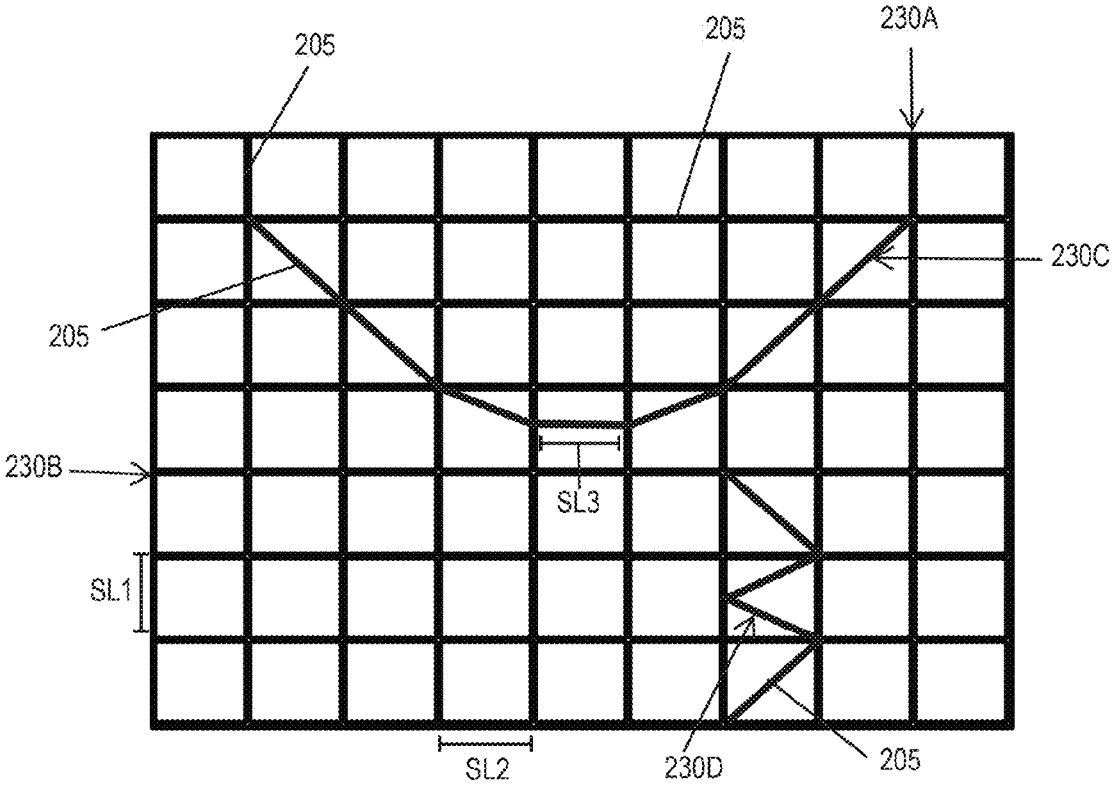
FIG. 2A is a schematic of the stitch pattern of the embroidered element in accordance with an embodiment of present invention.

At least a portion of the upper 105 is formed of a textile element including a yarn matrix. The yarn matrix is a self-supporting, embroidered structure including a plurality of interlocking yarn rows oriented in predetermined directions. Referring to FIG. 2A, the self-supporting, embroidered structure 200 includes a plurality of crossing yarns 205 (also called binding yarns) oriented in a predetermined pattern (e.g., in rows 230A, 230B, 230C). Each crossing yarn 205 includes a pair of component strands that interlock at selected locations along the length of the yarn. Specifically, referring to FIG. 2B, a crossing yarn 205 includes a first or upper strand 215A and a second or lower strand 215B that is generally aligned (e.g., vertically aligned) with the first strand. A strand is intended to include single fiber, filament, or monofilament, as well as an assemblage of textile fibers having a high ratio of length to diameter and normally used as a unit (e.g. includes slivers, roving, single yarns, plies yarns, cords, braids, ropes, etc.).

Figure 2B:
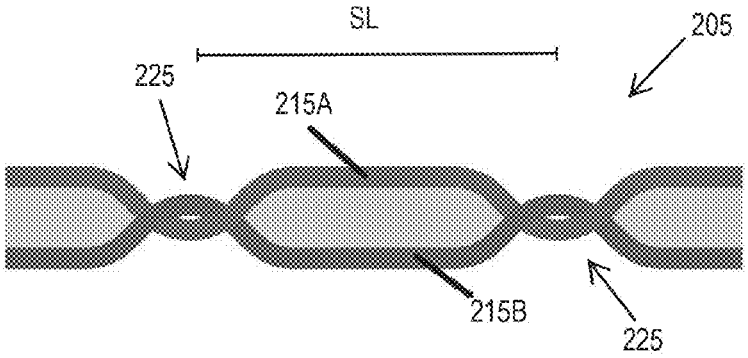
FIG. 2B is a cross sectional view of the crossing threads of the embroidered element in accordance with an embodiment of the present invention.

Referring to FIG. 2B, the crossing yarn 205 includes a first strand 215A and a second strand 215B coupled at selected locations along the length of the yarn. Specifically, the strands 215A, 215B are coupled via a stitch 225, i.e., an interlocking structure that locks the strands together. By way of example, a lockstitch (where the one strand wraps the other strand) is utilized. A lockstitch effectively secures the strands to each other, preventing unraveling of crossing yarn 205. While a particular lockstitch is illustrated (an over-lock stitch), it should be understood that different means of interlocking may be utilized to provide desired load extension characteristics to the textile structure. For example, other stitches such as a tatami stitch, a triaxial fill stitch, satin stitch, running stitch, chain stitch, etc. may be utilized.

The stitches 225 may be disposed at any predetermined location along the structure. Typically, the stitches 225 are disposed at regular intervals along the length of the crossing yarn 205. The distance between adjacent stitches is referred to as the stitch length SL. The strands 215A, 215B are substantially aligned with each other along the stitch length. The stitch length may be any distance suitable for its described purpose (to form a self-supporting embroidered element and/or footwear upper). For example, the stitch length may range from about 0.1 mm to about 5 mm (e.g., 0.5 mm to 4 mm).

By controlling the number of stitches in the crossing yarn 205, the overall stitch density of the embroidered structure 205 may be controlled to affect the overall properties of the structure (and thus the footwear upper). For example, the crossing yarn 205 and/or the self-supporting, embroidered structure 200 may include a high stitch density, a medium stitch density, or a low stitch density. In a high density stitch configuration, the strands 215A, 215B of the crossing yarn 205 include a stitch every 0.20 mm-1.50 mm (e.g., 1 mm). In a medium density stitch configuration, the strands 215A, 215B are stitched every 1.60-3.50 mm (e.g., 2 mm). A low stitch density configuration includes stitches every 3.60-5.00 mm (e.g., 4 mm). Accordingly, stitch density refers not only to the density of stitches in a crossing yarn 205, but also the number of stitches in a predetermined area of the embroidered structure 200 (e.g., number of stitches per square millimeter, centimeter, etc.). In a preferred embodiment, the stitch length is less than 5 mm. Stitch lengths of greater than 5 mm may introduce failures during the stitching process.

Each crossing yarn 205 (i.e., each strand 215A, 215B) may be formed of any material suitable for its described purpose (i.e., to create an embroidered structure and/or a footwear upper). By way of example, each strand may be formed of nylon, polyester, polyacrylic, polypropylene, polyethylene, metal, silk, cellulosic fibers (e.g., cotton), elastomers, etc. The strands 215A, 215B forming the crossing yarn 205 may be formed of the same or different materials. For example, the first strand 215A may be formed of a first material (e.g., nylon) while the second thread component 215B may be formed of a second material (e.g., polyester). In an embodiment, both strands of the crossing yarns 205 are formed of nylon (e.g., M60 nylon).

Additionally, the crossing yarn 205 may include fusible or non-fusible material. In an embodiment, the crossing yarn 205 (i.e., one or more strands 215A, 215B of the crossing yarn) may include thermoplastic polymers capable of transitioning to a liquid upon heating to a predetermined melting or glass transition temperature, and then recrystallizing when heat is removed to form a hardened structure (i.e., the crossing yarns are capable of fusing, combining with adjacent fusible materials or encapsulating adjacent non-fusible materials). By way of example, a strand 215A, 215B may be a filament of low-melt material (e.g., low-melt polyester having a melting point of less than 100° C.). By way of further example, the crossing yarn may include a sheath core or double covered yarn, including a sheath or covering of fusible material and a core including non-fusible material.

The crossing yarn 205 may further include a high tensile material, i.e., a material having a tensile strength of at least 1000 MPa. By way of example, strands 215A, 215B of the crossing yarn 205 may comprise an ultra-high molecular polyethylene (e.g., DYNEEMA, available from Royal DSM, Netherlands). Other high tensile strength materials include carbon fiber, fiberglass, aramids (e.g., para-aramid fibers and meta-aramid fibers) (KEVLAR, available from DuPont or TWARON, available from Tejin Aramid) and liquid crystal polymer fibers (VECTRAN, available from Celanese Acetate, LLC or ZYLON, available from Toyobo Corporation).

The diameter of the strands 215A, 215B may be any diameter suitable for their described purpose (i.e., to form a self-supporting embroidered structure/form a footwear upper). By way of example, the strands may be from about 0.003 mm to about 5 mm (e.g., 0.05 mm to 1 mm) in diameter.

Figure 3A:
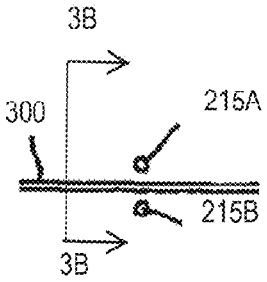
FIGS. 3A-3C illustrate schematics showing the relationship between layers of the embroidered element.
Figure 3B:
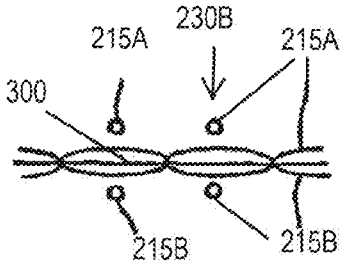
Figure 3C:
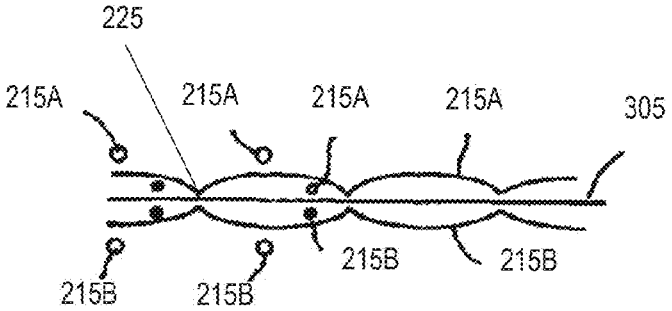

As noted above, the structure 200 may be formed via a modified embroidery process in which crossing yarns are selectively fixed to a temporary substrate. Briefly, the temporary substrate 300 (FIG. 3) is positioned on a frame. The first strand 215A is disposed on a first side of the temporary substrate and the second strand 215B is disposed on a second side of the temporary substrate such that it is generally aligned with the first strand. At predetermined intervals, the second strand 215B passes through the temporary substrate, over the first strand 215A, and back to through the substrate to form a stitch 225. The frame is repositioned and the process continues, forming a row or run along the temporary substrate. The resulting yarn 205 includes strands 215A, 215B generally aligned on opposite sides of the temporary substrate. Once the innermost crossing yarn rows are formed, additional overstitch or enclosing rows may be stitched into the temporary substrate such that the overstitch strands cross over their related innermost strands. This process may continue to form multiple layers of crossing yarns in the matrix. Once the desired number of rows is created, the temporary substrate is then removed, resulting in a self-supporting structure.

The embroidered structure 200 may include crossing yarns 205 ordered in a predetermined pattern. For example, the crossing yarns 205 may be provided in a matrix including a plurality of intersecting and/or overlapping strands 215A, 215B. Referring back to FIG. 2A, the matrix/structure 200 includes a first line or row or run 230A of crossing yarns 205 oriented along a first direction (e.g., generally vertically from the perspective of FIG. 2A) and a second row or run 230B of crossing yarns oriented along a second direction (e.g., generally horizontally from the perspective of FIG. 2A). Accordingly, a grid is formed, with the first row 230A being oriented substantially orthogonally to the second row 230B within the matrix.

Additionally, a third row or run 230C oriented along a third direction may be provided. The third row 230C defines a generally arcuate line having a predetermined radius of curvature. As shown, the third row 230C may include segments that bisect the grid blocks defined by the first 230A and second 230B rows. In other words, the third row or run 230C may be oriented at an angle with respect to each of the first row 230A and the second row 230B. In an embodiment, the angle of orientation may fall within the range of about 5° to about 90°.

The matrix may further include a fourth row or run 230D that forms a zigzag pattern within the structure 200.

As noted above, the embroidered structure 200 in accordance with the present invention includes multiple layers. That is, any of the crossing yarn rows 230A, 230B, 230C (i.e., any of strands 215A, 215B) may enclose/overlap or be enclosed/overlapped by any of the other rows. By way of example, and referring to FIGS. 3A, 3B, and 3C, the first crossing yarn row 230A may define a base or innermost layer of the matrix, being placed first on the temporary substrate 300 such that it does not overlap any other row. Subsequently, the second crossing yarn row 230B is placed on the temporary substrate such that the first strand 215A of the second row passes over the first strand of the first row 230A. Similarly, the second strand 215B of the second row 230B passes over the second strand of the first row 230A. Similarly, the third row 230C may be formed after the formation of the second row 230B such that it passes over each of the first row 230A and the second row.

The number of layers formed in the embroidered structure 200 is not particularly limited. In a preferred embodiment, the structure 200 includes a first or base layer and a second or overpass layer formed over the base layer. Additionally, a third, overstitch layer may be formed at selected locations within the structure 200 (i.e., the structure includes areas of three layers and areas of two layers).

As seen in the figure, the stitch 225 of any enclosing row may be aligned with or offset from the stitches of an enclosed row. Similarly, the stitches of an enclosing row may align with or be offset from the crossing yarns 205 of an enclosed row.

With this configuration, the properties (e.g., tensile strength) of the embroidered structure 200 may be customized for a particular use. For example, the strength of an area within the embroidered structure 200 may be modified by increasing the density of crossing yarns 205 and/or increasing the density of stitches 225 within the area. Specifically, a high density area would possess higher tensile/burst strength and lower breathability, while a low density area would possess a lower tensile/burst strength and higher breathability.

Figure 4:
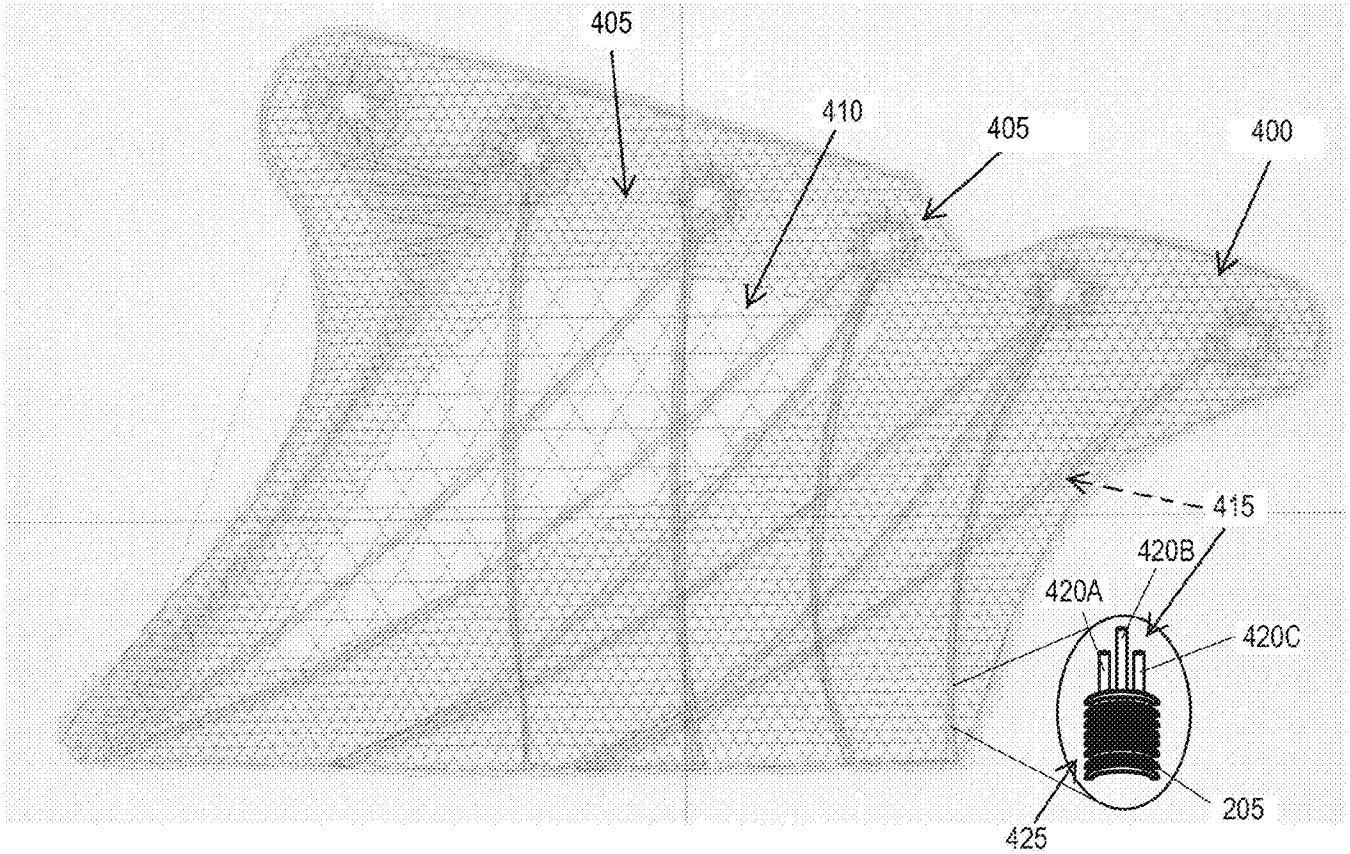
FIG. 4 illustrates a portion of a footwear upper including the embroidered element, with an inset showing a close-up of the support threads.

The process according to the present invention further permits the incorporation of structural, support, or compressible elements within the embroidered structure 200. Typically, these elements are not directly stitched into the matrix, but are instead captured within it. Stated another way, these elements are not yarns or strands stitched together, but are separate components secured to the embroidered structure by the yarns or strands. A structural element is an element designed to help carry the tensile load and/or disperse the forces applied to the upper during normal use. Referring the FIG. 4, showing embroidered structure portion defining a medium stich density area 405 and a low stitch density area 410, a plurality of structural elements 415 are disposed at selected locations within the structure. Each structural element 415 includes a plurality of high tensile strength strands 420A, 420B, 420C such as aramid strands (e.g., KEVLAR, available from DuPont). The number of strands 420A, 420B, 420C forming the structural element 415 is not limited, and may be selected in light of the desired level of support.

The structural element 415 is incorporated into the embroidered structure 200 by capturing the strands between structure layers. That is, each of the structural element strands 420A, 420B, 420C is at least partially captured within the embroidered structure 200 such that at least a portion of the strand is secured in position by a crossing element 205. In operation, the structural element 415 (i.e., the strands 420A, 420B, 420C) may be placed on one surface of temporary substrate and the rows 230A, 230B, 230C formed as described above. As a result, the structural element strands 420A, 420B, 420C are enclosed by the matrix, with the first 230A and second 230B rows of crossing yarn 205 passing over the structural element strands 230A, 230B, 230C (i.e., first crossing yarn strand 215A travels over one side of the structural element strands and the second crossing yarn strand 215B crossing over the opposite side of the structure element strands).

The structural element 415 may, furthermore, be enclosed within a tube, channel, or pocket 425 formed integrally with the embroidered structure 200. Specifically, the structural element 415 may be secured within the embroidered structure 200 by crossing yarns 205 that enclose the element. Referring to the expanded view in FIG. 4, a plurality of channel yarns 405 are arranged along the length of the structural element 415 (i.e., the plurality of structural element strands 420A, 420B, 420C) in a close side-by-side relationship such that the crossing yarn strands 215A, 215B are oriented generally parallel to each other, with the strand direction being generally orthogonal to the longitudinal axis of the structural element strands. Each channel yarn 405 includes first and second channel strands secured along its ends and unsecured between its ends to define a channel or pocket operable to receive the structural element. By way of example, a stem stitch may be utilized to form the channel or pocket 425.

The stitches 225 are positioned adjacent the lateral sides of the structural element 415 thereby forming the channel, tube, or pocket 425 that houses the structural element. The channel 425 secures the structural element 415 within the embroidered structure 200 such that the position of the structural element remains fixed. Additionally, the channel 425, covering the entire length of the structural element 415, enclosing it therein, serves to protect the structural element from the ambient environment (UV radiation, moisture, etc.). For example, aramid (e.g., KEVLAR) is UV and water sensitive. Accordingly, enclosing the aramid strands protects the strands, improving their longevity.

A structural element may further include textiles operable to impart improved tensile strength to the upper. By way of example, a nonwoven panel may be positioned within the eyelet row to reinforce the eyelet holes.

A support element is a component of the footwear upper operable to provide support to the wearer. Footwear often includes brace elements such as plastic splints configured to stabilize the ankle of the wearer (to prevent inversion and/or eversion) of the foot. Additional heel supports (e.g., heel counters) are incorporated to secure and limit movement of the heel during use of the shoe. Finally, other protective items may be incorporated such as toe covers. In general, these elements are formed of an elastomer such as thermoplastic polyurethane. These elements may be incorporated into the embroidered structure in a manner similar to that of the structural element. That is, the support element may be positioned on the temporary substrate and captured within one or more layers defined by the crossing yarn rows 230A, 230B, 230C. Additionally, a channel or pocket 425 formed of crossing yarns 205 may further secure the position of the support element, fixing its location within the structure 200.

A compression element is capable of absorbing impact forces. By way of example, a compressible element may be formed of foam (e.g., ethylene vinyl acetate foam). The compression element may be located within the upper at any desired location, e.g., along the collar of the upper, within the heel cup, or within the tongue of the shoe. The compression element may be incorporated into the embroidered structure 200 in a manner similar to that of the structural element. That is, the comfort element may be positioned on the temporary substrate and captured within one or more layers formed by the crossing yarn rows 230A, 230B, 230C. Additionally, a channel 425 formed of crossing yarns 205 may further secure the position of the support element, fixing its location within the structure 200.

Figure 5:
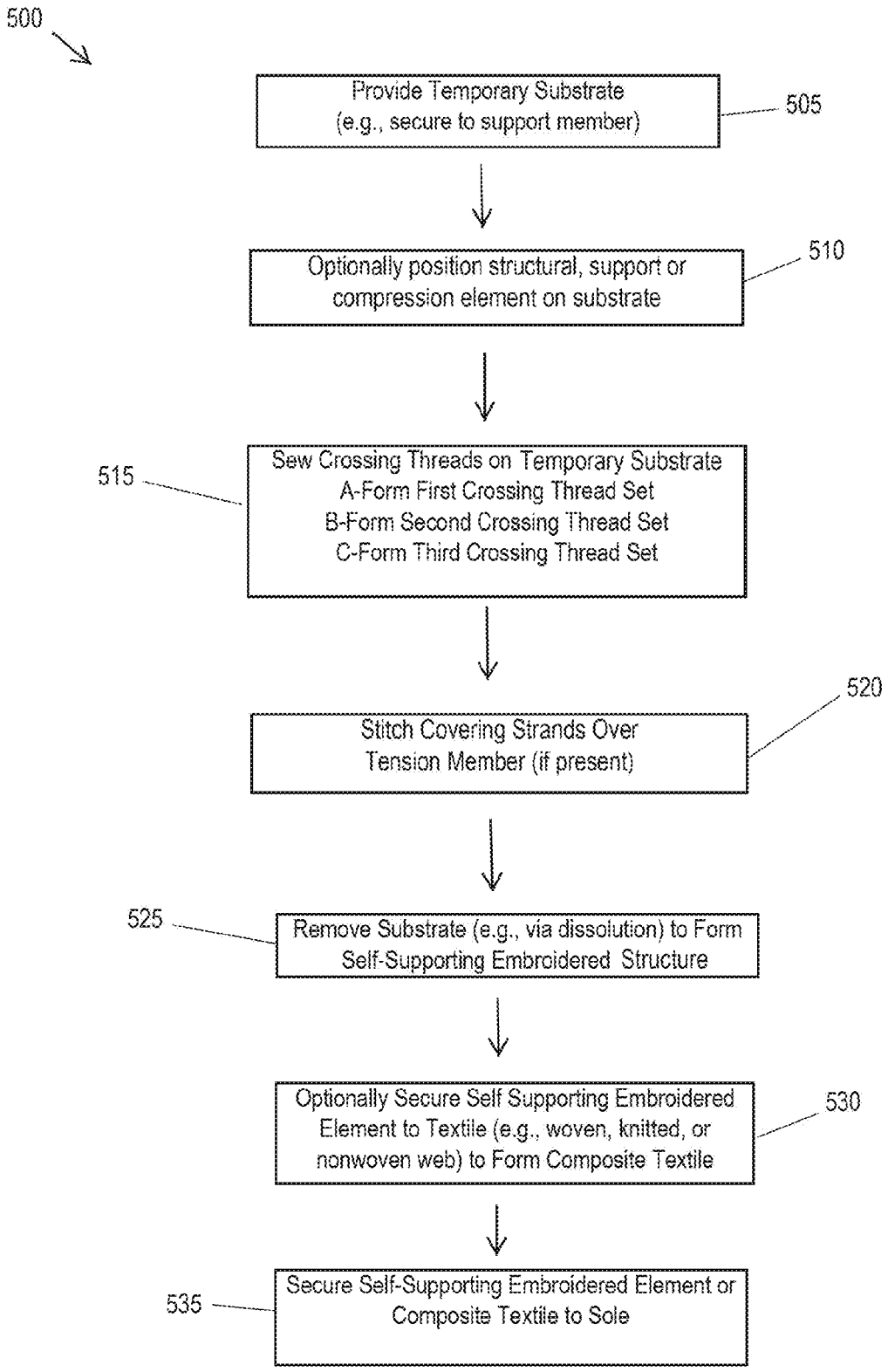
FIG. 5 is a flow diagram showing a process of forming the embroidered element.

The formation process 500 of the embroidered structure 200 is explained in greater detail with reference to FIG. 5. At step 505, the temporary substrate 300 is provided, being secured to a support frame. The temporary substrate 300 is formed of material that is removable in a manner that does not damage the embroidered structure 200. In an embodiment, the temporary substrate 300 is removed chemically, e.g., via dissolution. Dissolvable substrate materials are selected to minimize or prevent any harm to the physical properties of the materials forming the embroidered structure 200 during the dissolution process. By way of example, the temporary substrate 300 may be water soluble, being formed of, e.g., polyvinyl acetate, polyvinyl alcohol, or alginate. Accordingly, the dissolution medium is an aqueous medium such as water at elevated temperature (e.g., 50° C.). Alternatively, the temporary substrate may be soluble in an organic solvent such as acetone (e.g., an acetate-based substrate).

At Step 510, any of the structural elements 415, the support elements, or the compression elements may be placed on the temporary substrate 300. Each element is placed such that it corresponds to the proper location of the finished upper (collar, heel cup, toe cage, etc.). For example, the structural element 415 may be positioned on the temporary substrate 300 such that the longitudinal axis of the structural element generally aligns with the tensile load direction of the footwear upper. It is important to note that while the structural, support, or compression elements are discussed as being placed directly on the substrate 300, it should be understood that they may be added at any point during the embroidery process (e.g., after the base layer of crossing yarns 205 is secured to the temporary substrate).

At Step 515, the crossing yarn rows 230A, 230B, 230C are formed. Specifically, the crossing yarn rows 230A, 230B, 230C (including first strand 215A and second strand 215B) are applied to the temporary substrate 300 as described above (Step 415A).

At Step 525, the temporary substrate 300 is removed, e.g., via dissolution. By way of example, the temporary substrate 300 may be placed in a bath of dissolving agent such as water (e.g., water heated to a specified temperature (e.g., 50°), steam, etc.). By way of further example, the dissolving agent may be applied to the temporary substrate 300 via spray coating, etc. The substrate removal process may further involve the application of heat or mechanical agitation effective to aid in dissolution of the substrate without harming the embroidered structure 200. Once removed, a self-supporting embroidered structure results.

At Step 530, the self-supporting, embroidered structure 200 may undergo additional processing. For example, if fusible strands are present in the structure, the structure 200 may be heated to induce fusion. Once cooled, the fused fibers will stiffen the matrix, reducing its resiliency. Alternatively, the embroidered structure may be secured to another structure to form a composite structure. For example, the self-supporting embroidered structure 200 may be secured to a woven, knitted, or non-woven textile. The textile may form a portion of the upper, or may define an additional (exterior) layer within the structure. By way of specific example, the textile may define the border of the upper, providing a narrow band capable of being secured to the sole structure. Alternatively, the textile may be a decorative trim piece.

Additionally, a thermoplastic skin layer may be bonded to the embroidered structure 200 to provide water resistance and/or abrasion protection. In general, the skin layer is softened to infiltrate the fibers of the yarn matrix, then cooled, securing the skin layer to the upper.

Finally, in Step 535, either the resulting composite textile structure or the self-supporting embroidered structure 200 is secured to a sole structure to form the article of footwear.

Figures 6A, 6B:
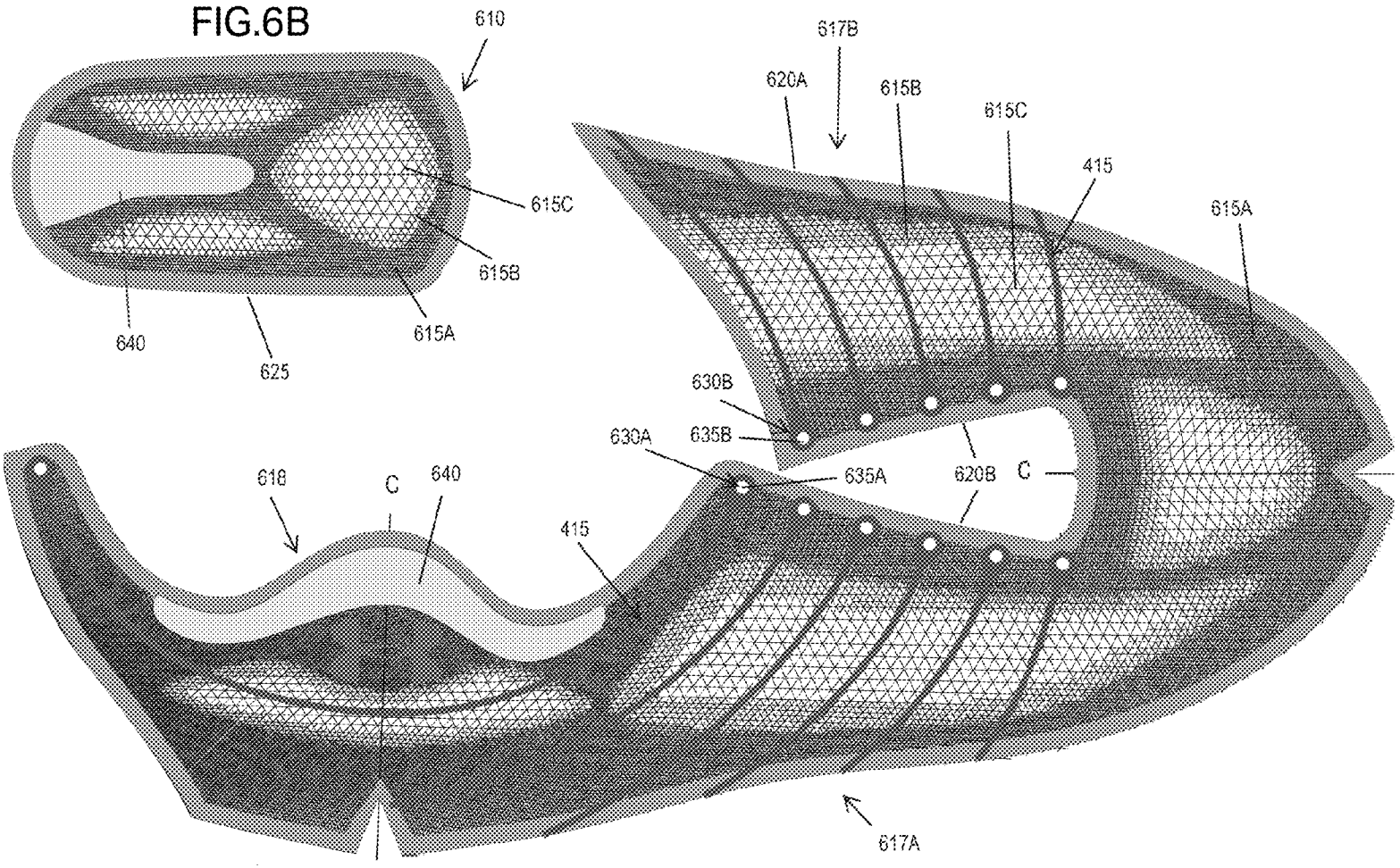
FIGS. 6A, 6B and 7 illustrate footwear uppers including the embroidered element in accordance with embodiments of the invention.

Examples of footwear uppers formed utilizing the process explained above is provided in FIGS. 6 and 7. Referring to FIG. 6, the footwear upper 600 includes a body 605 and a tongue 610, each including an embroidered structure 200 defining a high stitch density areas 615A, medium stitch density areas 615B, and low stitch density areas 615C. As explained above, areas 615C of low stitch density possess lower tensile strength, but possess higher breathability properties since the embroidered structure possesses a generally open, mesh-like configuration. As illustrated, low stitch density areas may be located along the toe cage, along the lateral side 617A and the medial side 617B, and within the heel cup 618. The medium stitch density areas 615B surround each of the low stitch density areas 615C, which, in turn, are surrounded by high stitch density areas 615A that extend to the outer perimeter 620A and interior perimeter 620B of the body 605 and the perimeter 625 of tongue 610. As illustrated, the lateral side 617A stitch pattern is a mirror image medial side 617B stitch pattern (as divided by body centerline C).

The footwear upper 600 further includes a plurality of eyelets disposed at selected locations along the body 605. Specifically, a plurality of spaced lateral eyelets 630A is oriented along the interior body perimeter 620B (proximate tongue opening). Similarly, a plurality of spaced medial eyelets 630B is oriented along the interior body perimeter 620B (proximate tongue opening).

A series of structural elements 415 are further included in the footwear upper. Specifically, a structural element 415 (e.g., one or more high tension strength strands captured in a channel or pocket 425) is associated with each eyelet of the plurality of eyelets 630A, 630B. As shown, each structural element is generally aligned with the direction of the tensile load, encircling each eyelet and extending from interior body perimeter 620B to exterior body perimeter 620A. Additionally, the body 605 further includes a structural element 415 running from the first eyelet 635A one the lateral side 617A around the centerline C of the heel cup 618 and to the first eyelet 635B on the medial side 617B.

Additionally, the footwear upper 600 includes one or more compression elements 640 disposed at selected locations. Specifically, a compression element 640 is positioned within the heel cup 618, proximate the body interior perimeter 620B (i.e., along the collar of the upper). As shown the compression element extends from the lateral side 617A of the heel cup to the medial side 617B of the heel cup. Additionally, the tongue 610 includes a compression element 640 operable to provide cushioning to the instep of the wearer.

The structural element 415, as well as the cushioning element 640, may be incorporated in the footwear upper as described above.

Figure 7:
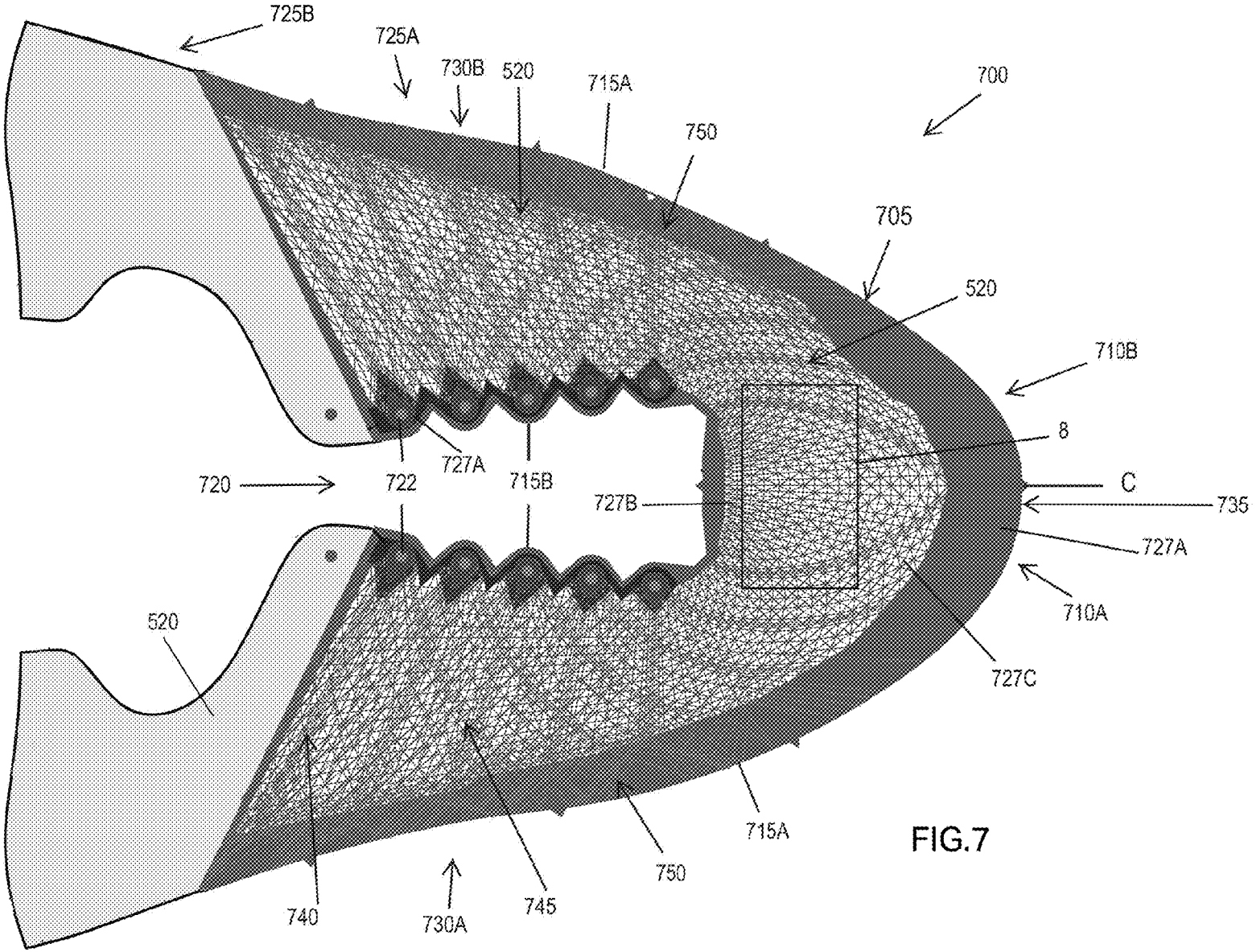

FIG. 7 illustrates a footwear upper 700 in accordance with an embodiment of the invention. The upper 700 includes a body 705 having a centerline C defining a lateral body side 710A and a medial body side 710B. The body, furthermore, defines a first or sole-facing perimeter 715A and a second or eyelet perimeter 715B, which, in turn, defines tongue opening 720. A plurality of eyelets 722 is disposed along the second perimeter 715B, being formed on each of the lateral and medial sides. In contrast with the embodiment of FIG. 6, the footwear upper 700 of FIG. 7 includes a forward embroidered portion 725A and a rearward non-embroidered (textile) portion 725B connected via, e.g., stitching. The embroidered portion 725A generally spans the forefoot and midfoot areas of the foot, while the non-embroidered portion 725B generally spans the heel area of the foot.

The embroidered portion 725A includes an embroidered structure 200 as described above, including a high stitch density area 727A, a medium stitch density area 727B, and a low stitch density area 727C. The lateral quarter 730A and the medial quarter 730B, furthermore, each includes a yarn matrix similar to that described above, having a first crossing yarn row 230A oriented general orthogonally to a second crossing yarn row 230B, which are each intersected by a generally arcuate third crossing yarn row 230C. Within the quarters 730A, 730B, the longitudinal axis of the first crossing yarn row 230A is oriented generally orthogonally to the edges of the first 715A and second 715B body perimeters, while the longitudinal axis of the second crossing yarn row 230B is oriented generally parallel to the perimeters.

Figure 8:
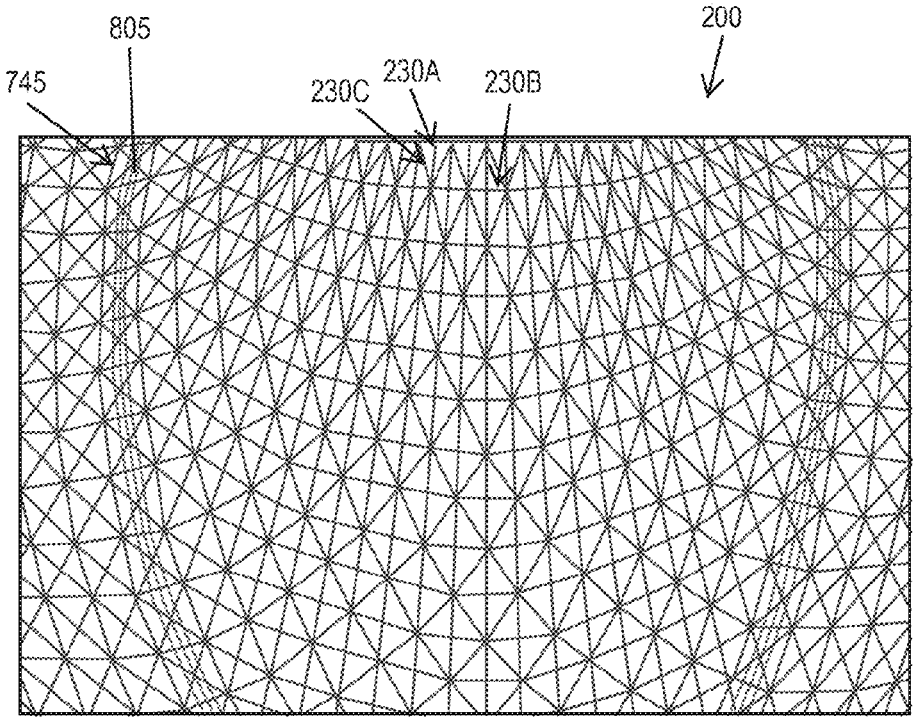
FIG. 8 illustrates a close-up of the vamp of the footwear upper shown in FIG. 7.

As best seen in FIG. 8, the embroidered structure 200 in the vamp 735 includes a first crossing yarn row 230A, a second crossing yarn row 230B, and a third crossing yarn row 230C. Similar to the above configuration, the first crossing yarn row 230A is oriented generally orthogonally to the first 715A and second 715B body perimeters. Each of the second crossing yarn row 230B and the third crossing yarn row 230C are generally arcuate. The embroidered structure 200 further includes tension yarns disposed at selected locations and configured to disperse tensile load on the upper 700. Specifically, the embroidered structure includes a first set 740 of tension yarns extending from the eyelet 722 to the first body perimeter 715A to define a generally straight row and a second set 745 of tension yarns extending forward from each eyelet 722 to the first body perimeter 715A to define a generally arcuate row. Each yarn of the sets 740, 745 includes a first strand 215A and a second strand 215B as described above. The strands 215A, 215B may be high tensile strength strands (i.e., strands having a tensile strength of at least 1000 MPa such as ultrahigh molecular weight polyethylene) or may be low tensile strength strands (e.g., nylon). In an embodiment, the tension yarns form the innermost layer of the embroidered structure.

The yarn matrix of the quarters 730A, 730B may further include plurality of individual overstitch strands 750 extending from each eyelet 722 to the first body perimeter 715A. Each strand may be configured to further improve the strength of the embroidered structure by compensating for lesser tensile forces applied to the shoe during use. That is, each strand may extend from the eyelet 722 at a predetermined angle that aligns with the expected axis of tensile load applied to the upper. In an embodiment, the overstitch strands 750 form the outermost layer of the embroidered structure.

As with the above embodiment, the embroidered structure 200 may further include a structural element to further compensate for forces applied to the eyelets during operation. By way of example, the upper 700 may include a reinforcing structure formed of a nonwoven textile that is incorporated into the embroidered structure 200.

The textile portion 725B may comprise materials utilized in conventional footwear. By way of example, it may comprise a knitted or woven fabric outer layer, a foam intermediate layer, and a knitted or woven fabric interior layer.

The above described invention provides a self-supporting embroidered element. This is in contrast with conventional uppers utilizing embroidery techniques, which require a substrate or foundation layer to which one or more strands are secured.

Utilizing the above invention, it is possible to create an article of footwear having an upper with predetermined physical properties, including, but not limited to, stretch, breathability, and abrasion resistance. During walking, running, or other ambulatory activities, forces induced in footwear may tend to stretch upper in various directions, with forces concentrated at various locations. The strands are located to function as structural elements in the upper, e.g. to permit, limit, or resist stretching in various directions or reinforce locations where forces are concentrated.

While the invention has been described in detail and with reference to specific embodiments thereof, it will be apparent to one skilled in the art that various changes and modifications can be made therein without departing from the spirit and scope thereof. For example, the materials forming the crossing yarns 205 may be any suitable for its described purpose. The yarns may be selectively utilized to modify properties of footwear 10 including stretch, stretch-resistance, air permeability wear-resistance, etc. Additionally, the yarns may be selectively placed within the upper to provide specific areas of upper with desired properties. For example, a particular material/structure may be concentrated in areas of the upper that experience wear, such as in forefoot region. If utilized for wear-resistance, the yarns may be formed of materials that exhibit high wear-resistance properties. Other functional yarns may be utilized such as those capable of transporting moisture and thus of absorbing sweat and moisture may be utilized. The yarns may be electrically conducting, self-cleaning, thermally regulating and insulating, flame resistant, and/or UV-absorbing.

In addition, fusible yarns may be utilized. Fusible yarns soften when exposed to heat of a predetermined temperature, hardening once cooled (e.g., at ambient conditions). Fusible yarns are formed of thermoplastic polymer material, such as polyurethane, nylon, polyester, and polyolefin. Fusible yarns may also include a mixture of a thermoplastic yarn and polyester or nylon. The structure of such yarns may include a thermoplastic yarn surrounded by a non-thermoplastic yarn; a non-thermoplastic yarn surrounded by thermoplastic yarn; and a combination of thermoplastic and non-thermoplastic yarns. After being heated to the melting temperature, the thermoplastic yarn fuses with the non-thermoplastic yarn (e.g. polyester or nylon), stiffening the textile material. In order to improve the bond between the thermoplastic material and the yarn, the yarn's surface is texturized. The thermoplastic material melts at least partially in the process and fuses with the yarn. After pressing, the embroidered structure 200 is cooled so that the bond is hardened and fixed.

The strands of the crossing yarns 205 may possess any dimensions (size/shape) suitable for their described purpose. The density of the stitches 225 may also be selected to modify the characteristics of the upper. For example, areas with relatively high concentrations of stitches 225 may flex to a lesser degree than areas with relatively low concentrations of stitches. Similarly, areas with relatively high concentrations of stitches may be less air-permeable than areas with relatively low concentrations of stitches.

The athletic footwear includes running shoes, baseball shoes, basketball shoes, cross-training shoes, cycling shoes, football shoes, tennis shoes, soccer shoes, walking shoes, and hiking boots, etc. Footwear styles may further include non-athletic styles such as dress shoes, loafers, sandals, etc.

The embroidered structure 200 may be formed utilizing any suitable embroidery apparatus or process, whether by machine or hand. In machine embroidery, a variety of conventional embroidery machines may be utilized to form embroidered structure 200, and the embroidery machines may be programmed to embroider specific patterns or designs from one or a plurality of threads. In general, an embroidery machine forms patterns or designs by repeatedly securing a thread to various locations such that portions of the thread extend between the locations and are visible. Conventional embroidery machines may form patterns or designs on temporary substrate by forming satin-stitches, running-stitches, or fill-stitches, each of which may utilize a lock-stitch to secure thread to base layer. Satin-stitches are a series of zigzag-shaped stitches formed closely together. Running-stitches extend between two points and are often used for fine details, outlining, and underlay. Fill-stitches are series of running stitches formed closely together to form different patterns and stitch directions, and fill-stitches are often utilized to cover relatively large areas.

Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

We claim:

1. An upper for an article of footwear, the upper comprising:

a textile structure including a plurality of yarn rows, each yarn row of the plurality of yarn rows including a first strand aligned with a second strand, the first and second strands being interlocked via stitches disposed at selected locations along a length of the yarn row, wherein:

the strands of the plurality of yarn rows are not secured to a substrate;

the stitches of the plurality of yarn rows define a stitch density within the upper, the stitch density being the number of stitches present within a selected area of the upper;

a first selected area of the upper possesses a first stitch density;

a second selected area of the upper possesses a second stitch density; and the first stitch density is greater than the second stitch density.

2. The upper according to claim 1, wherein:

each distance between adjacent stitches along the yarn row is 5 mm or less; and the first strand and the second strand possess a property, and the property of the first strand differs from the property of the second strand.

3. The upper according to claim 1, further comprising a third area of the upper, the third area possessing a third stitch density, wherein the second stitch density is greater than the third stitch density.

4. The upper according to claim 1, wherein, in the first stitch density area, the stitches are present every 0.20 mm to 1.50 mm.

5. The upper according to claim 1, wherein in the second stitch density area, the stitches are present every 1.60 mm to 3.50 mm.

6. The upper according to claim 1, wherein:

the upper comprises a body defining a perimeter including sole perimeter and an eyelet perimeter; and the sole perimeter possesses the first stitch density.

7. The upper according to claim 6, wherein:

the eyelet perimeter further possesses the first stitch density; and an area between the sole perimeter and the eyelet perimeter possesses the second stitch density.

8. The upper according to claim 7, wherein:

the body of the upper includes a lateral body side, a medial body side and a tongue opening between the lateral body side and the medial body side; and a tongue is coupled to the body of the upper such that the tongue is positioned within the tongue opening, wherein the tongue comprises a textile structure including a plurality of intersecting yarn rows, each yarn row of the plurality of yarn rows including a first strand aligned with a second strand, the first and second strands being interlocked via stitches disposed at selected locations along a length of the yarn row.

9. The upper according to claim 1, wherein the stitches interlocking the first strand and the second strand are configured as a running stitch or a satin stitch.

10. The upper according to claim 1, wherein each of the first strand and the second strand comprises nylon.

11. An upper for an article of footwear, the upper comprising:

a textile structure including a plurality of yarn rows, each yarn row of the plurality of yarn rows including a first strand aligned with a second strand, the first and second strands being interlocked via stitches disposed at selected locations along a length of the yarn row, wherein:

the strands of the plurality of yarn rows are not secured to a substrate, the stitches of the plurality of yarn rows define a stitch density within the upper, the stitch density being the number of stitches present within a selected area of the upper, a first selected area of the upper possesses a first stitch density and a second selected area of the upper possesses a second stitch density, and the first stitch density is greater than the second stitch density;

a channel formed by a plurality of channel strands secured by channel stitches; and an element positioned within the channel such that each channel strand of the plurality of channel strands extends from a first lateral stitch on a first lateral side of the structural element, over the structural element, and to a second lateral stitch on a second lateral side of the structural element.

12. The upper according to claim 11, wherein the element is a structural element, a compression element, a support element, or a combination thereof.

13. The upper according to claim 11, wherein the channel covers a length of the structural element.

14. The upper according to claim 11, wherein each distance between adjacent stitches along the yarn row is 5 mm or less.

15. The upper according to claim 11, wherein the structural element is a tensile strand formed of material possessing a tensile strength of at least 1000 MPa.

* * * * *